United States Patent [19]

Yurgevich

[11] Patent Number: 4,944,421

[45] Date of Patent: Jul. 31, 1990

[54] ANGLE REINFORCEMENT

[75] Inventor: Howard J. Yurgevich, Monticello, Ind.

[73] Assignee: Rosby Corporation, Monon, Ind.

[21] Appl. No.: 368,410

[22] Filed: Jun. 19, 1989

[51] Int. Cl.[5] ..... B65D 6/32; B65D 6/34; B65D 90/02

[52] U.S. Cl. ..... 220/1.5; 220/71; 220/DIG. 29

[58] Field of Search ..... 200/15, 3, 71, DIG. 29

[56] References Cited

U.S. PATENT DOCUMENTS

| | | | |
|---|---|---|---|
| 2,801,024 | 7/1957 | Osborne | 220/DIG. 29 |
| 3,045,858 | 7/1962 | Sohnsen | 220/71 |
| 3,456,829 | 7/1969 | Glassmeyer . | |
| 3,464,103 | 9/1969 | Harris . | |
| 3,528,582 | 9/1970 | Rigollot | 220/71 |
| 3,646,609 | 2/1972 | Bodenheimer . | |
| 3,780,903 | 12/1973 | Clarkin | 220/71 |
| 3,799,383 | 3/1974 | Gerhard | 220/71 |
| 4,183,163 | 2/1979 | Clark | 220/1.5 |
| 4,688,691 | 8/1987 | Christian | 220/3 |

*Primary Examiner*—George E. Lowrance

*Attorney, Agent, or Firm*—Barnes & Thornburg

[57] ABSTRACT

A container for intermodal transportation of goods is disclosed which has a floor, a roof, and includes side walls having a plurality of vertically oriented stacking frame posts joining a floor-level lower stacking engagement fitting and a roof-level upper stacking engagement fitting. At least one post in each side wall has an inner post member and an outer post member fixed to each other to form a generally box-shaped structure. A reinforcement plate is situated adjacent the floor-level lower stacking engagement fitting and fixed within the box-shaped structure to the inner post member. A notch in each inner post member adjacent the lower stacking engagement fitting exposes an inner surface of the reinforcement plate to permit the insertion of a weld joining the reinforcement plate inner surface to the engagement fitting. An angle member is received within the notch and extends onto the engagement fitting. A perimetral weld joins the angle member to the reinforcement plate inner surface, the inner post member and the engagement fitting so as to strengthen the stacking frame against racking.

8 Claims, 1 Drawing Sheet

ANGLE REINFORCEMENTBACKGROUND OF THE INVENTION

This invention pertains generally to means for joining one end of a box-like column structure to a support. This invention particularly pertains to the use of such joining means in the manufacture of containers used in the shipment of goods, the containers being adapted for transfer from one mode of transportation to another.

Containers adapted for transfer from one mode of transportation to another typically have certain overall standardized dimensions and characteristics which are common so as to permit the containers to be stacked one upon another and secured one to another in this stacked arrangement. The containers are generally secured together by fittings which are fixed to the ends of vertically oriented columns or posts in the sidewalls of such containers. The posts and fittings of the single container are joined by other structures to form a framework often referred to as a stacking frame. The fittings for engagement of vertically adjacent containers generally take the form of apertured hollow steel castings into which certain standard locking means can protrude so as to lock the container either to another container or to a vehicle on which the container is to be transported.

Generally, posts of the stacking frames are provided at the four outer most corners of the container and, where containers are sufficient length, additional intermediate stacking frames are provided inward from each end. An example of a container including such intermediate stacking frames is shown in Bodenheimer, U.S. Pat. No. 3,646,609. The stacking of such containers one upon the other, particularly during transportation, puts considerable stress on the stacking frames. While the stacking frames are well suited to resist compressive loads, their resistance to racking due to lateral forces is significantly less.

In order to strengthen the frame structure against racking, it is known to include a triangular web between the vertical posts and the floor and/or roof structure of the container as shown in Glassmeyer, U.S. Pat. No. 3,456,829. While the existence of such webs in a closed end wall of the container would have little or no effect on the ability of such a container to hold goods, the presence of such a web at an intermediate stacking frame would interfere with the placement of goods within the container and thus prove to be unacceptable.

Therefore, an object of the present invention is to provide reinforcement between the vertical posts and the floor of intermediate and other stacking posts of an intermodal container which will not interfere with the placement of goods within the container.

SUMMARY OF THE INVENTION

In accordance with the present invention an improved connecting means connects a lower end of a container stacking frame post to an underlying engagement fitting which forms part of the floor structure. The stacking frame post generally comprises a box shaped structure including an inner post wall. A reinforcement plate is situated against the floor within the box shaped structure and is fixed to the inner post wall. A notch is provided in the inner post wall adjacent the floor so as to expose an inner surface of the reinforcement plate. Joining means is provided for joining the reinforcement plate inner surface to the floor in the form of a first weld between the lower most margin of the reinforcement plate inner surface and the floor. An angle member is then situated within the notch and extends on to the floor. A second weld joins the angle member to the reinforcement plate inner surface and to the floor. Preferably, the outer dimension of the angle member closely matches but is uniformly spaced from the edge of the notch exposing the inner surface of the reinforcement plate such that the second weld comprises a perimetral weld about the angle member joining the angle member to the inner post wall.

While the present invention has particular utility with respect to stacking frames of intermodal containers used in the transportation of goods, it will be recognized by those skilled in the art that the invention has broader application to reinforce the connection between any box shaped post and any floor structure to which the post is to be secured. When the present invention is employed, the post has a significantly enhanced resistance to a bending force yet preserves substantially all of the load carrying space which would otherwise be sacrificed were a conventional triangular web to be employed. These and other features and advantages of the present invention will become apparent to those skilled in the art upon consideration of the following detailed description of a preferred embodiment exemplifying the best mode of carrying out the invention as presently perceived. The detailed description particularly refers to the accompanying figures.

DESCRIPTION OF THE PREFERRED EMBODIMENT

Figure 1:
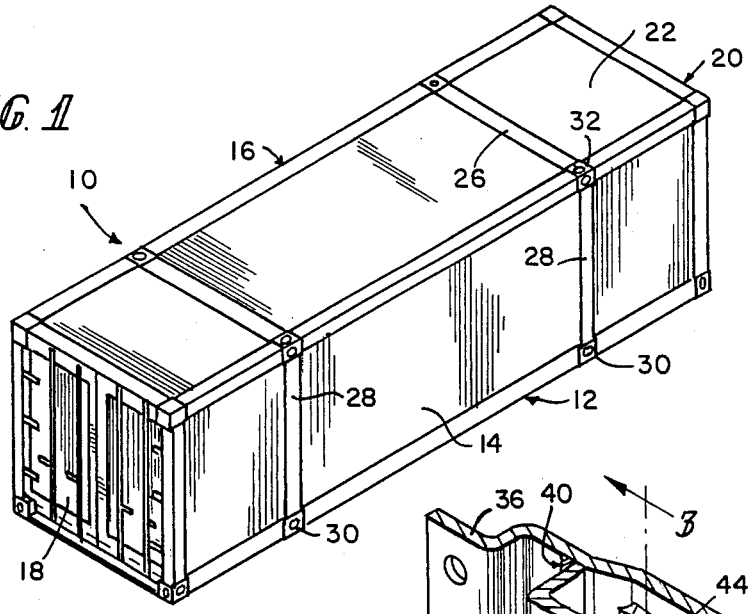
FIG. 1 is a perspective view of a intermodal container in which the invention can be employed.

A container 10 especially adapted for intermodal transportation of goods is shown in perspective in FIG. 1 to contain floor 12, sidewalls 14 and 16, end walls 18 and 20, and roof 22. A pair of intermediate stacking frames 24 and 26 are provided which are spaced inward from end walls 18 and 20. Each of the intermediate stacking frames 24 and 26 includes a vertically oriented stacking frame post 28 which joins a floor level lower stacking engagement fitting 30 to a roof level upper stacking engagement fitting 32. During the construction of such container, the entire floor 12 including the lower stacking engagement fittings 30 is brought together with an entire side wall 14 including the vertically oriented stacking frame posts 28. It then becomes necessary to join these two subassemblies together and in particular to join the vertically oriented stacking frame posts 28 to the underlying engagement fittings 30 so as to provide the desired strength and its stability for the container particularly when situated in a stacked arrangement, either in storage or during transportation.

Figure 2:
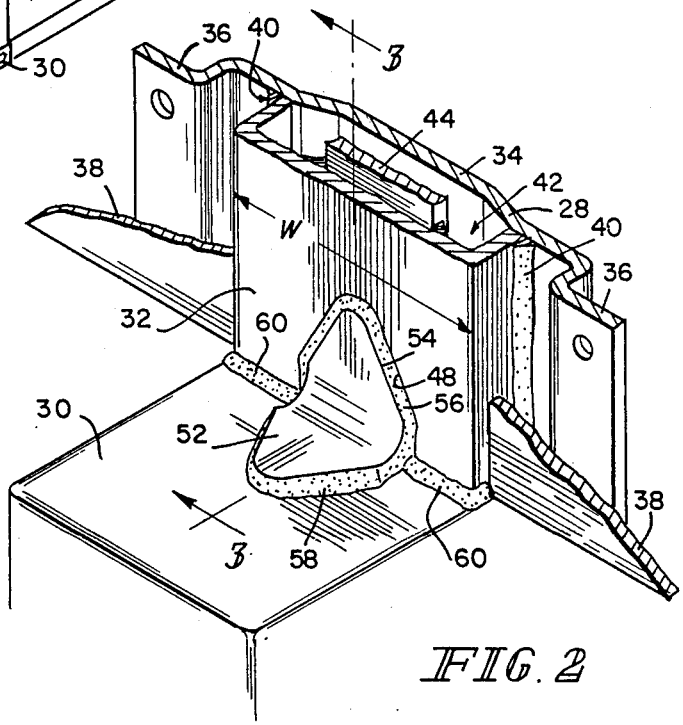
FIG. 2 is a perspective view taken from the inside of the container shown in FIG. 1, broken away to show the connection between the vertically oriented stacking post and underlying engagement fitting.

As shown in FIG. 2, the stacking frame post 28 includes an inner post member 32 in the form of a U-shaped channel member having a width W approximately the same as the width of the underlying stacking engagement fitting 30. A reinforcement plate 44 is welded to an inner surface of the inner post member 32 so as to be positioned contiguous to the lower end of the inner post member 32. The inner post member 32 is joined to an outer post member 34 which is generally hat-shaped in cross section and includes laterally extending flanges 36 which are joined to the wall surface defining sheet 38. The outer post member 34 and inner post member 32 are welded together by weld seams 40 so as to form a generally box shaped opening or interior 42. It will be seen that the reinforcement plate 44 is thus situated within the box like interior 42 of the stacking frame post 28..

Figure 3:
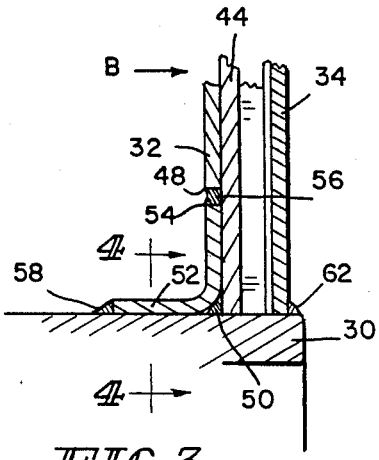
FIG. 3 is a sectional view of the connection shown in FIG. 2 taken along line 3—3.
Figure 5:
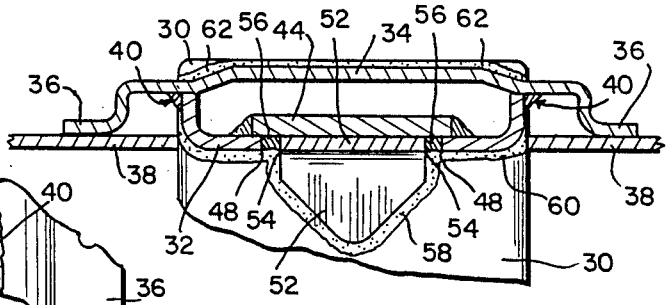
FIG. 5 is a sectional view of the connection taken along line 5–5 of FIG. 4.
Figure 4:
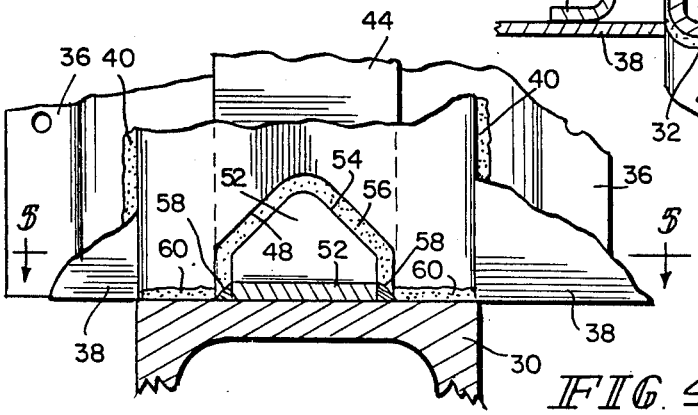
FIG. 4 is a sectional view of the connection taken along line 4–4 of FIG. 3.

The inner post member 32 includes an opening defined by edge 48 as shown in FIGS. 2, 3 and 5 which exposes a portion of the surface of reinforcement plate 44 including the lower end thereof. The opening defined by edge 48 allows the joining of the lower inner margin of the reinforcement plate 44 to the engagement fitting 30 by weld line 50 as shown in FIG. 3. If the opening defined by edge 48 is not provided, then no weld connection can be made between the reinforcement plate 44 and the engagement fitting 30, thus significantly reducing the strength of the connection between the stacking post 28 and engagement fitting 30.

After the weld 50 is made, an angle member 52 preferably having a thickness substantially the same as inner post member 32 is inserted into the opening defined by the margin 48. The angle member 52 preferably has an outside edge 54 which is similar in shape to edge 48, yet spaced from edge 48 so as to define a channel into which weld 56 is placed. Weld 56 joins the reinforcement plate 44, the inner post member 32, and angle member 52 together. A weld line 58 joins the angle member 52 to engagement casting 30 while weld line 60 secures the base of the inner post member 32 to the engagement casting 30. An additional weld line 62 joins the outer post member 34 to engagement casting 30 to complete the assembly. The presence of the inner reinforcement weld 50 and the angle member 52 and associated welds 56, 58 and 60 permit the post 28 to successfully resist even very large bending moments B as shown in FIG. 3.

Although the invention has been described in detail with reference to the illustrated preferred embodiment, variations and modifications exist within the scope and spirit of the invention as described and as defined in the following claims.

What is claimed is:

1. In a container having a floor and walls including a plurality of vertically oriented posts joined to the floor, at least one of the posts comprising a generally box-shaped structure including an inner post wall and a reinforcement plate situated adjacent the floor within the box-shaped structure and fixed to the inner post wall, the improvement comprising: a notch in the inner post wall adjacent the floor exposing an inner surface of the reinforcement plate, and joining means for joining the reinforcement plate inner surface to the floor.

2. The improvement of claim 1 wherein the joining means comprises:

a first weld joining the reinforcement plate inner surface to the floor, an angle member received within the notch and extending onto the floor, and a second weld joining the angle member to the reinforcement plate inner surface and to the floor.

3. The improvement of claim 2 wherein the second weld comprises a perimetral weld about the angle member joining the angle member to the inner post wall.

4. An improved connecting means for connecting a lower end of an intermodal container stacking frame post to an underlying engagement fitting wherein the stacking frame post comprises an inner post member, an outer post member fixed to the inner post member to form a generally box-shaped container stacking frame post, and a reinforcement plate situated within the box-shaped structure and fixed to the inner post member adjacent the engagement fitting, the improved connecting means comprising: a notch in the inner post member adjacent the engagement fitting exposing an inner surface of the reinforcement plate, and joining means for joining the reinforcement plate inner surface to a top surface of the engagement fitting.

5. The improved connecting means of claim 4 wherein the joining means comprises:

a first weld joining the reinforcement plate inner surface to the engagement fitting, an angle member received with the notch and extending onto the engagement fitting, and a second weld joining the angle member to the reinforcement plate inner surface and to the engagement fitting.

6. The improvement of claim 5 wherein the second weld comprises a perimetral weld about the angle member joining the angle member to the inner post member.

7. A container for intermodal transportation of goods comprising: a floor, a roof, and including side walls having a plurality of vertically oriented stacking frame posts joining a floor-level lower stacking engagement fitting and a roof-level upper stacking engagement fitting, at least one post in each side wall comprising an inner post member and an outer post member fixed to each other to form a generally box-shaped structure, and a reinforcement plate situated adjacent the floor-level lower stacking engagement fitting and fixed within the box-shaped structure to the inner post member, a notch in each inner post member adjacent the lower stacking engagement fitting exposing an inner surface of the reinforcement plate, a weld joining the reinforcement plate inner surface to the engagement fitting, an angle member received with the notch and extending onto the engagement fitting, and a perimetral weld joining the angle member to the reinforcement plate inner surface, the inner post member and the engagement fitting.

8. The container of claim 7 wherein the outer post member comprises a hat-shaped channel member having flange portions fixed to a wall surface defining member, and the inner post member comprises a U-shaped channel member having a width about the same as the width of the engagement fitting yet less that the outer post member, the inner post member being fixed to the outer post member inside the outer post flange portions.

* * * * *